United States Patent [19]

Hanger

[11] 4,239,196

[45] Dec. 16, 1980

[54] ENGINE STAND

[76] Inventor: James E. Hanger, P.O. Box 16, Panama City, Fla. 32401

[21] Appl. No.: 37,403

[22] Filed: May 9, 1979

[51] Int. Cl.[3] ..... B25B 11/00

[52] U.S. Cl. ..... 269/17

[58] Field of Search ..... 254/133, 134, 8 B, 124, 254/2 R; 269/71, 17, 50, 51

[56] References Cited

U.S. PATENT DOCUMENTS

| | | | |
|---|---|---|---|
| 1,600,835 | 9/1926 | Manley | 269/71 |
| 2,073,998 | 3/1937 | Raby | 254/2 R |
| 3,218,056 | 11/1965 | Kaplan et al. | 269/17 |
| 3,381,953 | 5/1968 | Miller | 269/17 |
| 3,931,956 | 1/1976 | Hawkins | 254/8 B |

*Primary Examiner*—Robert C. Watson

*Attorney, Agent, or Firm*—Bailey, Dority & Flint

[57] ABSTRACT

An engine stand is illustrated having a universal mounting apparatus for securing loads such as different sizes of automotive engines and the like to a rotatable face plate which has a wheeled stand therefor. The invention further contemplates an extensible wheeled support on the stand having adjustable means for balancing and stabilizing the load carried by the universal mounting.

3 Claims, 3 Drawing Figures

ENGINE STAND

BACKGROUND OF THE INVENTION

Engine stands and the like constructed in accordance with the prior art have been relatively complex, generally requiring a wheeled stand providing spaced vertical support members between which the load in the form of an engine and the like is carried. Such supports limit accessibility to the load or other structure upon which repair or construction work is being carried out. In the case of engines, different makes, models and sizes require mounting plates of special construction for attaching the load to the face plate. The problem is brought about because the surfaces of the various makes of engines are at different levels requiring the flat face plate to be joined with an irregular surface. The standard face plate provided for any given engine would have bosses and the like which are specially provided for that make of engine. The plates are expensive and one for each type of engine to be serviced must be provided.

Accordingly, one of the objects of the present invention is to provide a universal mounting face plate which may accommodate an engine and the like of any size and manufacture.

Another important object of the invention is the provision of a load balancing and stabilizing means in the form of an extensible wheeled member carried by the wheeled base which may be raised in order to fix and balance the load as positioned by the universal mounting means which may require more spacing from the face plate of the engine stand in some instances than in others.

Prior art devices are typified by the engine stand illustrated in U.S. Pat. No. 3,218,056 wherein a special spaced forward support is provided for stabilizing the forward portion of the engine.

BRIEF DESCRIPTION OF THE INVENTION

It has been found that a universal motor mounting apparatus may be provided for use on an engine stand wherein adapter members are attachable to the engine for accommodating studs and transfer bars carried thereby to accommodate a mounting plate. The mounting plate is positionable upon the face plate of the engine stand. It is important that the stud members be positionable at an angle in order to accommodate not only engine surfaces at various levels but also inclined engine surfaces. This may be accomplished by providing a pivotal connection between the threaded members and the studs. It has also been found that forwardly extensible wheeled load leveling members may be provided by a wheel base member and such preferably incorporate a vertical threaded stud member for immobilizing the base portion and leveling the load positioned by the universal mounting apparatus.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
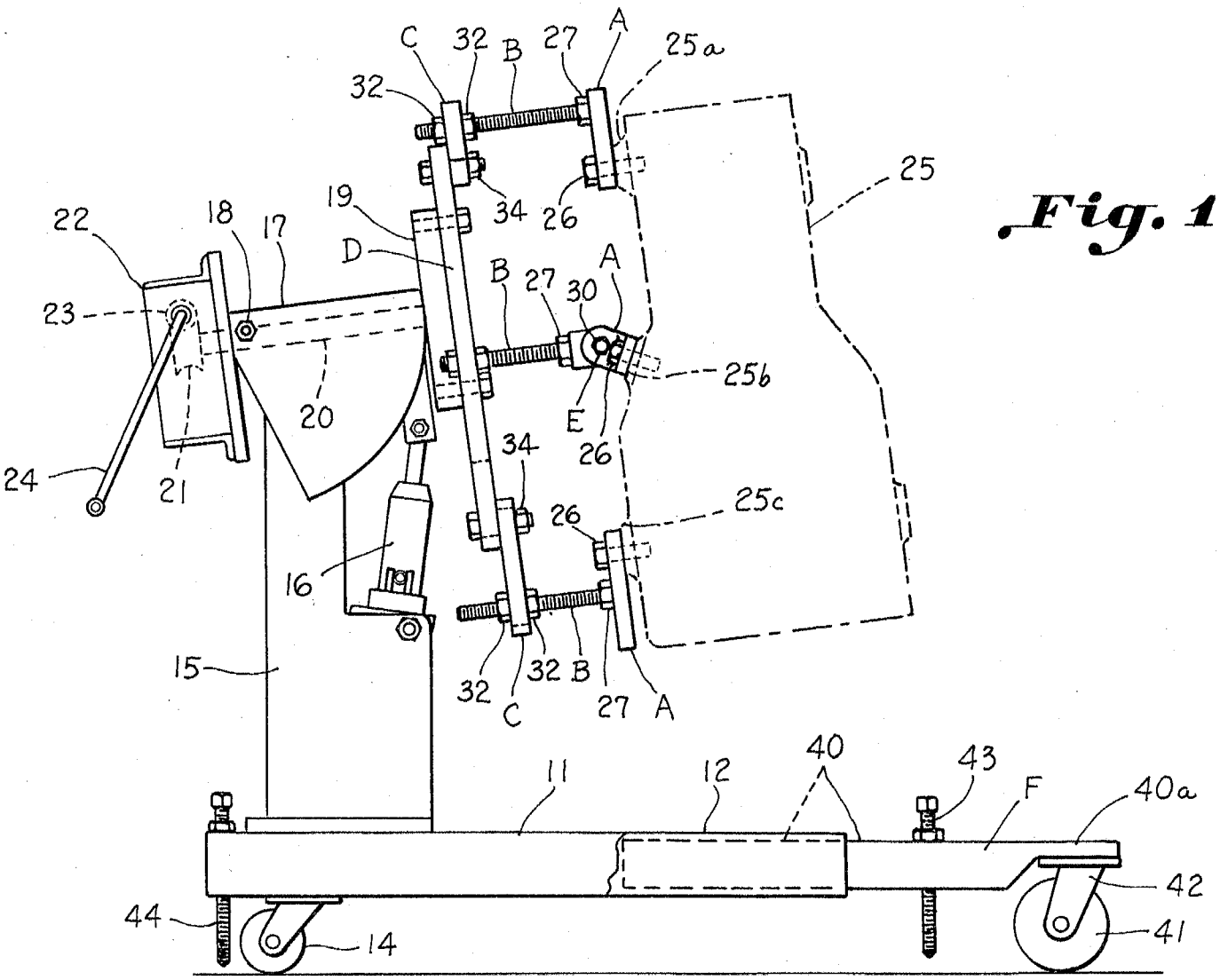
FIG. 1 is a side elevational view illustrating an engine stand constructed in accordance with the present invention.

A motor mounting apparatus for use on an engine stand has a wheeled base with a vertical stand carried thereby and a rotatable face plate on said stand. A plurality of threaded members A are attachable to the engine. A plurality of threaded studs B are receivable upon the threaded members. A plurality of transfer bar members C are attachable to the studs, and a mounting plate D is attachable to the transfer bar members and to the face plate. Means E pivotally connect at least one of the threaded members and one of the studs. Forwardly extensible wheeled load leveling elements F are carried by the base for balancing and stabilizing loads carried by the mounting apparatus.

The engine stand includes a wheeled base having a pair of spaced legs 11 and 12 which extend forwardly from a transverse bridging member 13. Rear wheels 14 are carried adjacent the rear of the legs 11 and 12 or by the transverse support 13. A vertical standard or column 15 carries the engine mounting mechanism. The column 15 carries a vertically disposed hydraulic ram 16 for raising and lowering the face plate mounting means 17 which is pivotally secured to the column as at 18. The face plate is illustrated at 19 and is driven for rotation by the shaft 20. The shaft 20 carries a worm gear 21 within the gear box 22. The worm 23 may be turned manually by the crank 24 to rotate the load illustrated in the form of an engine by broken lines 25 in FIG. 1.

It will be noted that the engine 25 has a number of pads **25*a*, 25*b* and 25*c* to accommodate various accessories or other associated engine parts. In this instance, the pads accommodate threaded members A which are attachable thereon by bolts or other threaded means 26. Each of the members A have an internally threaded member such as a nut 27 which is secured thereto as by welding (not shown). In the case of an inclined surface of the load such as illustrated at 25*d*, a pivotal connection E is provided for joining the members A with the threaded stud members B. This is provided in the form of a vertical leg 28 carried upon the member A together with a complimentary leg 29 which carries the internally threaded member 27 thereon. The respective legs 28 and 29 are connected together as by a pivot pin 30**.

Figures 2, 3:
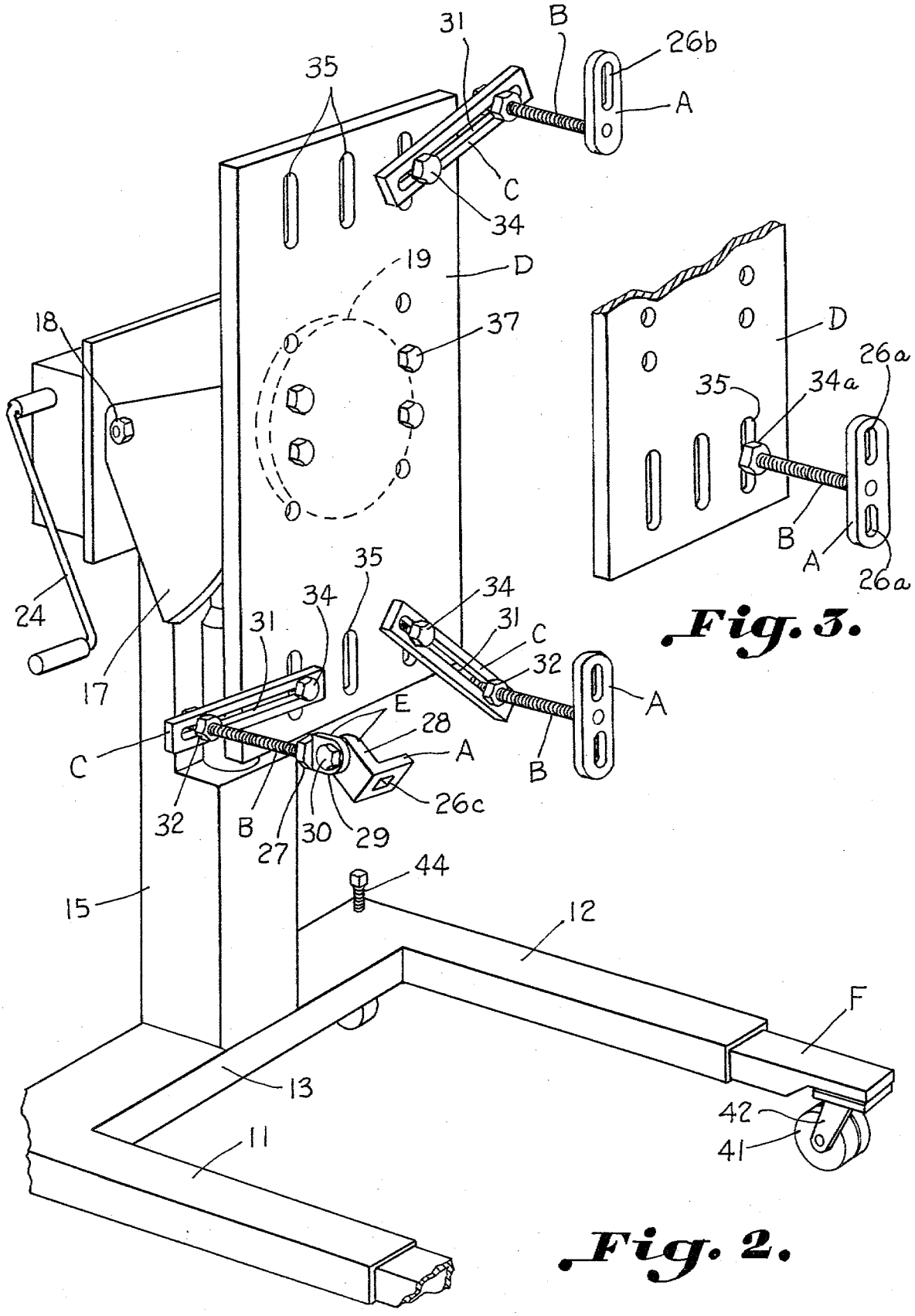
FIG. 2 is a perspective view illustrating the universal mounting apparatus and extensible front wheeled portion.
FIG. 3 is a perspective view illustrating a modified form of adapter member, stud and mounting plate which does not require a transfer bar for connection.

The transfer bars C are illustrated as including elongated slot portions 31 for accommodating an opposed end portion of the threaded shank members D for securement thereto by suitable nuts 32. The slots 31 permit suitable disposition of the transfer bar to accommodate threaded fastening means 34 positionable within a slotted portion 35 within the mounting plate D. The mounting plate D has connection as by suitable bolts 37 with the face plate 19. FIG. 3 shows a slightly modified form of the invention wherein a member A has a pair of spaced slots **26*a* for accommodating fastening means 26 for securement to the engine 25. It will be observed that corresponding single slotted portions 26*b* are provided as may be dictated by the particular pad upon which the attachment member A is to be connected. FIG. 2 illustrates an opening 26***c* which will accommodate attachment of that modified form of attachment A to the inclined motor pad 25*b*.

Referring again to FIG. 3 in particular, it will be noted that the threaded stud member is connected as by fastening means 34*a* directly to the plate D as the slot 35 coincides therewith so as not to necessitate the use of a transfer bar for this particular connection.

Referring especially to FIG. 1, it will be noted that a forwardly extensible wheeled element F includes a rear portion 40 which is receivable internally within the forward end portions of the legs 11 and 12. This support portion 40 extends forwardly forming a flat wheel attachment portion 40*a*. The wheel 41 is attached as by a caster 42. A vertical threaded shank portion 43 is carried by a forward portion of the member 40 so as to balance the load depending upon its size and relative disposition with respect to the face plate 19. Suitable threaded shank portions 44 may be carried adjacent the opposite ends of the legs 11 and 12 so that the wheeled base may be raised to immobolize the stand and properly balance the load.

It is thus seen that a versatile engine mount has been provided for positioning a load in a variety of positions for being turned 360 degrees with maximum accessibility. The apparatus is universally adaptable to various sizes and load types. The construction of the engine mount is simplified while making same useful for a variety of work especially in rebuilding and repairing engines of various sizes and makes.

While a preferred embodiment of the invention has been described using specific terms, such description is for illustrative purposes only, and it is to be understood that changes and variations may be made without departing from the spirit or scope of the following claims.

What is claimed is:

1. A motor mounting apparatus for use on an engine stand having a wheeled base with a vertical stand carried thereby and a rotatable upright face plate on said stand comprising:

a plurality of threaded members attachable to said engine;

a plurality of substantially horizontal threaded studs receivable upon said threaded members;

a plurality of transfer bar members attachable to said studs;

a mounting plate attachable to said transfer bar members and to said face plate;

said transfer bar members having elongated slots therein facilitating adjustable positioning of the transfer bars upon said mounting plate;

a vertically disposed hydraulic ram for raising and lowering said face plate, and forwardly extensible wheeled load leveling elements carried by said base.

2. The structure set forth in claim 1 wherein said load leveling elements include upright threadable load elevating members.

3. A motor mounting apparatus for use on an engine stand having a wheeled base with a vertical stand carried thereby and a rotatable upright face plate on said stand comprising:

a plurality of threaded members attachable to said engine;

a plurality of substantially horizontal threaded studs receivable upon said threaded members;

a plurality of transfer bar members attachable to said studs;

a mounting plate attachable to said transfer bar members and to said face plate; and said transfer bar members having elongated slots therein facilitating adjustable positioning of the transfer bars upon said mounting plate and adjustable attachment of said threaded studs thereto in position laterally of said mounting plate;

a vertically disposed hydraulic ram for raising and lowering said face plate mounting means;

whereby said threaded studs may be attached in the same plane for simple effective attachment.

* * * * *